United States Patent [19]

Mahoney

[11] Patent Number: 4,458,266

[45] Date of Patent: Jul. 3, 1984

[54] VIDEO MOVEMENT DETECTOR

[75] Inventor: Trevor W. Mahoney, Modbury North, Australia

[73] Assignee: The Commonwealth of Australia, Canberra, Australia

[21] Appl. No.: 395,076

[22] PCT Filed: Oct. 21, 1981

[86] PCT No.: PCT/AU81/00149

§ 371 Date: Jun. 11, 1982

§ 102(e) Date: Jun. 11, 1982

[87] PCT Pub. No.: WO82/01454

PCT Pub. Date: Apr. 29, 1982

[30] Foreign Application Priority Data

Oct. 22, 1980 [AU] Australia ..... PE6171

[51] Int. Cl.[3] ..... H04H 7/18

[52] U.S. Cl. ..... 358/105; 358/108; 340/541

[58] Field of Search ..... 358/105, 108; 340/541

[56] References Cited

U.S. PATENT DOCUMENTS

| | | | |
|---|---|---|---|
| 3,740,466 | 6/1973 | Marshall et al. | 358/105 |
| 3,816,648 | 6/1974 | Noll et al. | 358/126 |
| 3,988,533 | 10/1976 | Mick et al. | 358/105 |
| 4,081,830 | 3/1978 | Mick et al. | 358/210 |
| 4,148,062 | 4/1979 | Kamin | 358/105 |
| 4,198,653 | 4/1980 | Kamin | 358/105 |
| 4,249,207 | 2/1981 | Harman et al. | 358/105 |
| 4,257,063 | 3/1981 | Lowghry et al. | 358/105 |

*Primary Examiner*—Howard W. Britton
*Assistant Examiner*—Edward L. Coles
*Attorney, Agent, or Firm*—Cushman, Darby & Cushman

[57] ABSTRACT

The system of detecting motion by means of a video detector which consists in directing at least one television camera (20) into the surveillance area, and reproducing the image from the said camera on a television (25) screen, characterized in that the television screen display is divided into a matrix of elemental detection zones (15) positioned in a selected number of columnms (1 to 14) with each detection zone being a selected number of scan lines (0–8) high, processing the elemental detection zones in each column in a sequential manner by integrating (28) a first detection zone in the column and at the last scan line converting to digital format in an analogue-to-digital converter (29) and placing in a memory (49) and resetting the integrator to process the next elemental detection zone and so on and subsequently comparing scans with earlier corresponding scans to detect errors representing movement, further characterized by programmable window means generated by a rectangular window generator (51) to elect which error signals are to actuate a display or alarm (47).

15 Claims, 9 Drawing Figures

VIDEO MOVEMENT DETECTOR

BACKGROUND OF THE INVENTION

This invention relates to a video movement detector and in particular it relates to a detector of the general type originally developed by the Commonwealth of Australia and described in the specification of Austrialian Letters Patent No. 432,885, inventor Kevin W. Boyle, which comprise directing a scanning device into the area to be protected and storing the information received repeatedly and detecting change in subsequent stored information, a scanning device in that case including a television camera directed at the area to be scanned and feeding the information so obtained to a storage type tube, the area being scanned at repeated intervals to record any significant change in the information stored, a comparison rate divider being used to increase successive signal difference by virtue of a greater time difference.

This device used the photoconductive target of a vidicon camera tube as a frame difference generator, and in principle the vidicon face plate was exposed uniformly to white light and the video signal from the surveillance camera applied to the beam current electrode for one frame in every ten.

If the frame difference signal exceeded a threshold level, the position at which this difference occurred in the display was stored and the difference signal was integrated at that point over a small elemental area.

An alarm circuit was triggered if the integrated signal exceeded a second threshold, detection being restricted to an area within the display defined by a rectangular window, the height, width and position of which could be set by the operator.

Progress in semi-conductor technology led to the development of a semi-conductor version of the movement detector and in that system the TV display was divided into a matrix of elemental detection zones having a selected width and being a selected number of rows high to give a large number of elemental detection zones.

A number of identical integrators were used with one assigned to each of the columns and the video signal from the surveillance camera was demultiplexed column by column into the integrators and integrated over a selected number of TV scan lines.

Outputs from the integrators were multiplexed in turn into a high speed analogue-to-digital converter during spaced scan lines and the digital output from the converter for each of the elemental detection zones was compared with its respective value which had been stored in a random access memory at a previous time.

If the difference betwen comparisons exceeded a value set by a sensitivity switch, a small strobe pulse was mixed into the video display to indicate which elemental zone was in error and an alarm was generated. The memory was periodically updated to compensate for slow changes of ambient light level and for thermal drifts within the TV camera. The detection of movement zone was defined by a rectangle surrounding blocks of elemental detection zones, the shape and position of which rectangle could be set by the operator.

It was convenient to use a matrix 15 columns wide and 44 rows high, giving a total of 660 elemental detection zones and each elemental zone could conveniently be 3 microseconds wide and 5 TV scan lines high.

SUMMARY OF THE INVENTION

This device however required a high speed analogue-to-digital converter and 15 integrators with their associated video multiplexers, and every sixth scan line was not actively used but was required for electronic processing and every second frame was ignored because of a 2:1 interlace. Use of a single rectangle to define the detection of movement zone limited its effectiveness in certain applications.

The reason for having a selectable window was to limit surveillance to a selected area and to avoid areas where spurious signals would be generated, but according to the known systems, errors still could occur by spurious signals in the window, and research was continued to produce a more selective system in which, for instance, small areas such as trees in a landscape which would show an error signal due to wind-induced movement could be excluded from the window, or bright areas which affected the exposure of the general area could be cancelled, and it is therefore an object of the present invention to provide a better area control and more effective isolation of smaller areas where signals of unwanted characteristic occur.

A further object of the present invention was to find a simpler approach to developing the video movement detector without sacrificing the concept of a large matrix of elemental detection zones.

The invention consists in a method of detecting motion by means of a video detector which comprises directing at least one TV camera into the surveillance area, reproducing the image from the camera on a TV screen, dividing the TV screen display into a matrix of elemental detection zones positioned in a selected number of columns with each detection zone being a selected number of scan lines high, processing the elemental detection zones within each column in a sequential manner with at least one selected column processed in each TV frame by integrating a first detection zone in the column and at the last scan line converting the data to digital format in an analogue-to-digital converter and storing in a memory, resetting the integrator to process the next elemental detection zone of the column until all zones in the column are completed, then sequentially similarly submitting all remaining columns to the integrator one for each succeeding frame, and comparing subsequently produced scans with earlier corresponding scans to detect errors representing movement defining by means of at least a window of selectable dimensions those errors to be directed to the alarm circuitry.

The apparatus for carrying out the above method will now be described with reference to the accompanying drawings which are to be taken as illustrative of the principles involved but not necessarily as limiting the invention, the scope of which will be defined in the appended claims.

DESCRIPTION OF THE PREFERRED EMBODIMENTS

Figure 1:
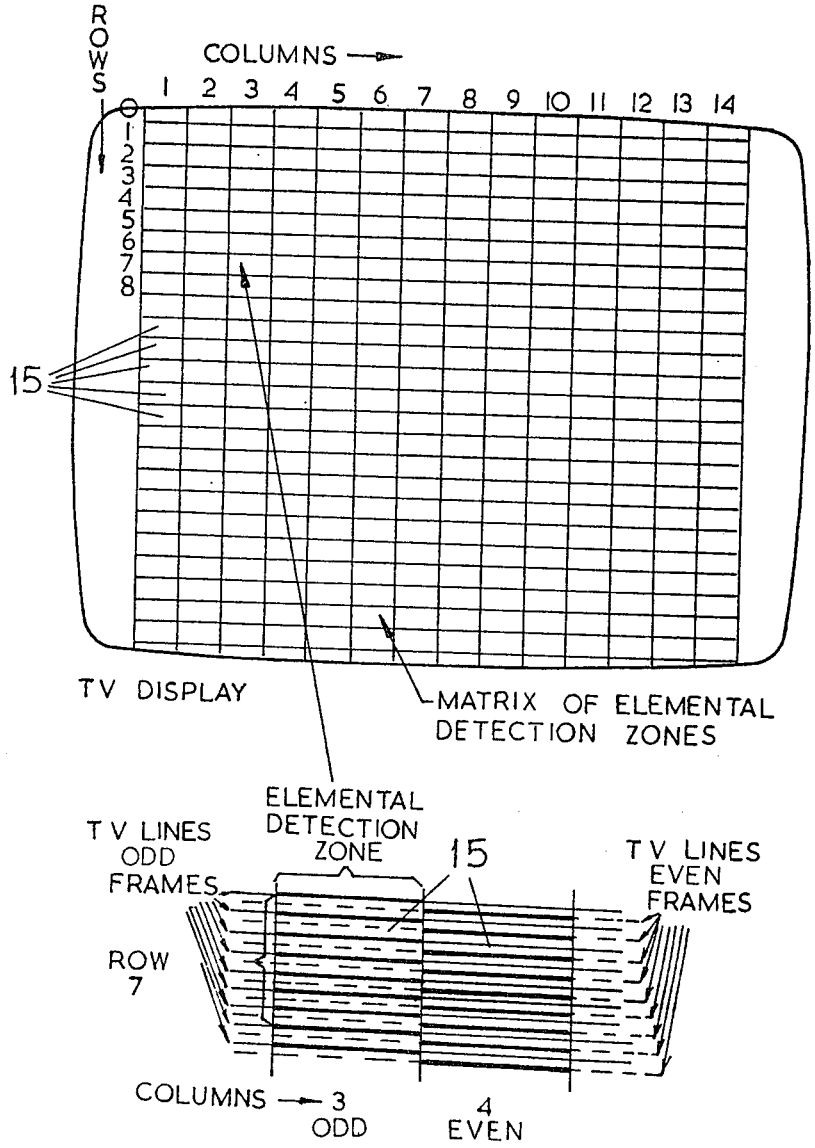
FIG. 1 is a schematic view showing the TV screen with the matrix of elemental detection zones outlined thereon, and showing below the screen the format of the elemental detection zone.

Referring first to FIG. 1, the TV screen has a series of columns numbered 1 to 14 which each contain a series of elemental detection zones 15 having their height defined by a selected number of TV scan lines. In the form about to be described, which shows interlaced scan lines, eight referenced vertically in FIG. 2 as 1 to 8, are used to allow an eight camera array to be achieved if more than a single camera is required.

Figure 2:
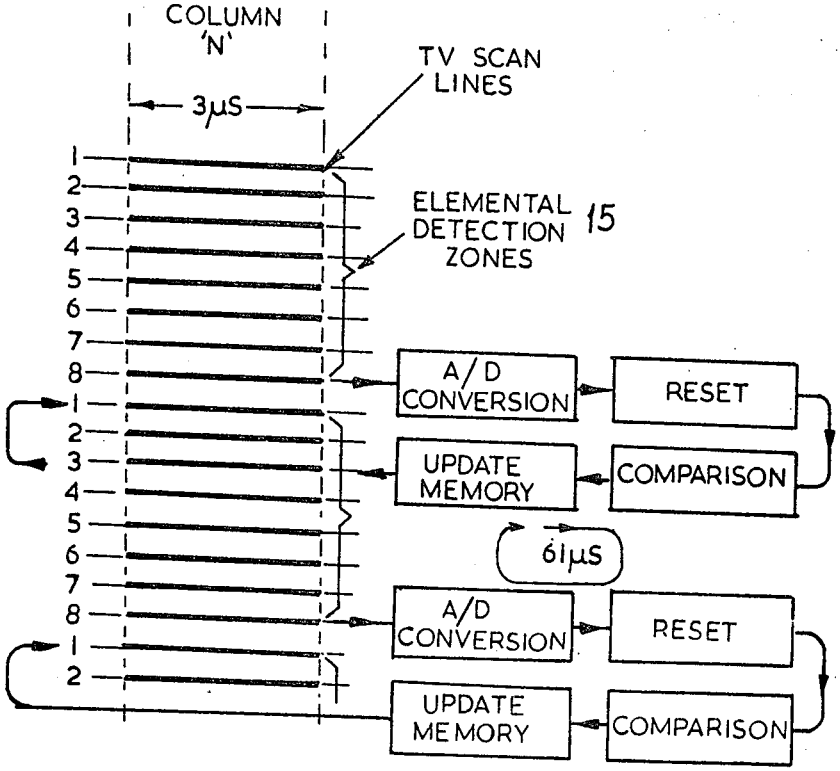
FIG. 2 is a block diagram showing how the elemental detection zones are processed.

FIG. 2 depicts how according to this invention instead of integrating the video signal over the 8 TV scan lines in all the columns used, using identical integrators, the present invention integrates and processes only one column of elemental detection zones during each TV frame.

In this way, only one integrator and a relatively slow analogue-to-digital converter are required and the system then cycles through all columns in N TV frames where N is the number of columns.

Thus it may be assumed that processing commences in any one column by gating the video signal from the surveillance camera into an operational amplifier integrator and integration of the signal in this column continues until, at the end of every selected gate pulse, in this case the eighth gate pulse, a start conversion pulse is applied to the analogue-to-digital converter which immediately issues a BUSY signal. This signal remains asserted while conversion of the output from the integrator to its 8 bit digital equivalent is in progress.

Upon completion of the analogue-to-digital conversion the BUSY signal triggers a monostable multivibrator which resets the integrator in readiness to integrate the next elemental detection zone. The digital output from the analogue-to-digital converter for every elemental detection zone is stored in a random access memory. Subsequent digitized elemental detection zones are compared with their previously stored values. If the absolute difference between the two values exceeds a sensitivity value, an error signal is generated. Only those errors occurring within the detection window are directed to the alarm circuitry.

Figure 3:
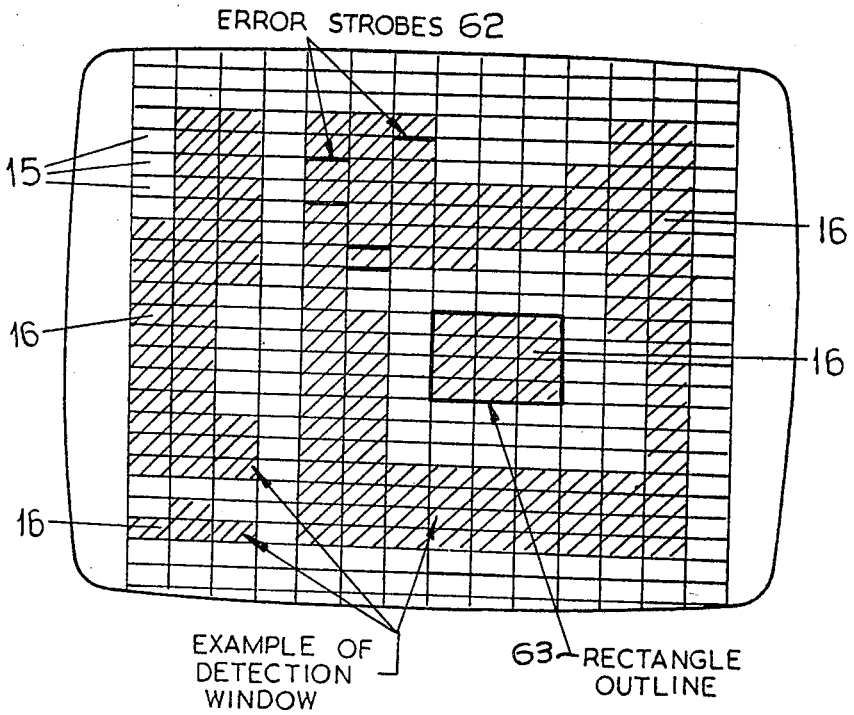
FIG. 3 is a view of the TV screen shown in FIG. 1 but showing examples of detection windows which can be formed and how errors can be shown in relation to any detection zones having such errors.

The detection window is composed with the aid of a rectangle generator whose height, width and position is adjusted to surround a block of elemental detection zones, which can be added to or deleted from the detection window and thus the detection window is programmable and it is possible to programme areas in and out as desired. FIG. 3 shows such a window arrangement where the shaded areas 16 represent independent windows.

Variations in ambient illumination, thermal drifts within the TV camera, and objects which move permanently into and out of the scene are compensated for by periodically updating the elemental detection zone memory. The window forming arrangement will be described later herein.

Figure 5:
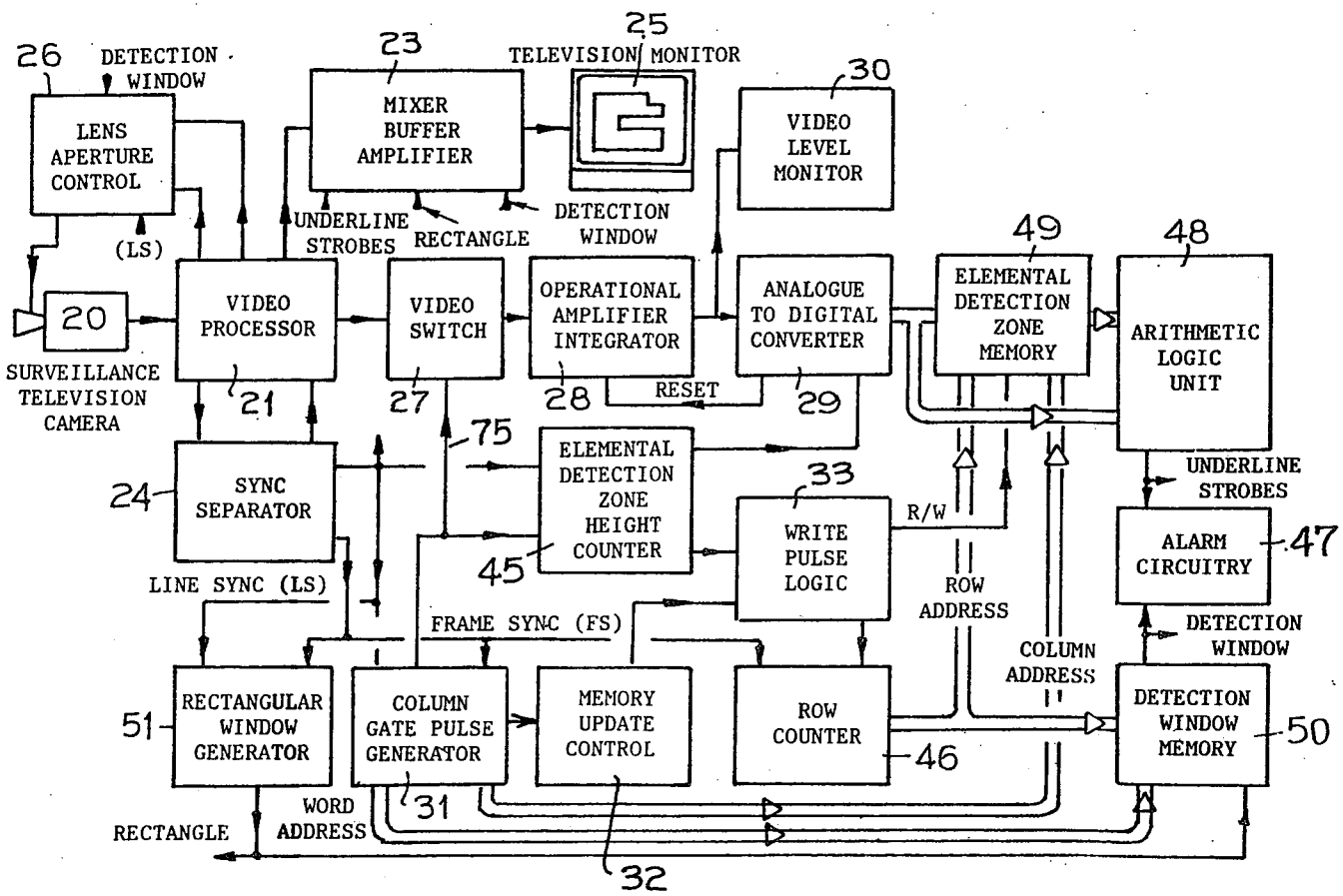
FIG. 5 is a block diagram showing the basic circuitry of the device when used with a single camera.

The lens of the video camera accepts the video output signal from the camera and varies the lens aperture in a feedback loop, as shown in FIG. 5, maintaining a constant average video signal level over the range of ambient light conditions and it is preferred to provide the movement detector with at least two switchable modes of operation when the surveillance camera is fitted with such a lens, the first mode being arranged to control the aperture for constant average video signal over the entire TV display, the second mode having the video signal gated by the detection window and fed to a peak detector whose output is chopped by the line synchronising pulses to provide an artificial video signal which is switched to the lens.

In the first mode very bright highlights outside the detection window depress the video signal within the detection window and hence reduce the sensitivity of the system. These highlights have no influence on the video signal within the detection window when operating in the second mode.

With the single TV camera approach, the analogue-to-digital (A/D) converter operates once at the end of each elemental detection zone in the column being processed. For example, if each elemental detection zone is set to 8 TV scan lines in height, the A/D converter operates over one TV scan line in 8, remaining idle for the first seven scan lines. This idle time may be used to process the integrated video signals from multiple TV cameras, where the number of TV cameras does not exceed the number of scan lines defining the height of each elemental detection zone.

Figure 4:
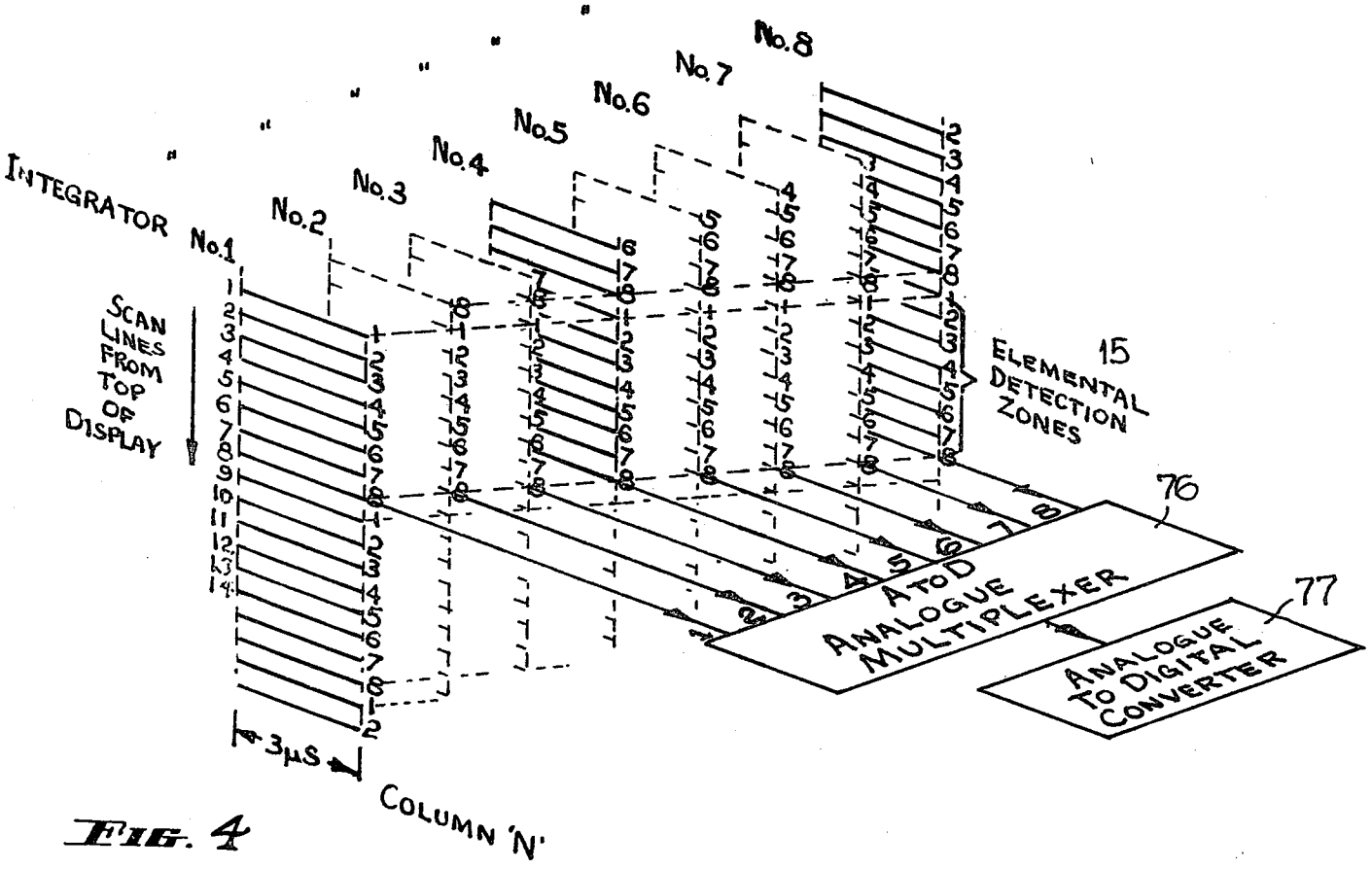
FIG. 4 is the perspective view showing how using a series of integrators, one for each of a selected number of TV cameras, is associated with an analogue multiplexer and the analogue-to-digital converter used in common but sequentially with all elemental detection zones within a defined window or windows.

With reference to FIG. 4, the video input signals from eight separate surveillance TV cameras are coupled to 8 separate operational amplifier integrators through 8 video switches, clamp/sync clippers and video amplifiers. The video input signals are simultaneously gated into their respective integrators by the column gate pulse.

In any one column, the video input signal from TV camera no. 1 is gated into its associated operational amplifier integrator by the column gate pulse. At the end of every eighth column gate pulse, commencing on TV scan line number 1, the output from the integrator is multiplexed to the A/D converter and converted to its binary equivalent. This binary number is then compared with its previously stored value to determine if a change has occurred. The integrator is then reset. Similarly, the video input signal from TV camera no. 2 is gated into its associated operational amplifier integrator by the same column gate pulse. At the end of every eighth column gate pulse, commencing on TV scan line no. 2, the output from this integrator is multiplexed to the A/D converter and the binary output compared with its previously stored value. Integrator no. 2 is then reset. This technique is repeated for each of the eight TV cameras connected to the system.

It can be seen that the elemental detection zones for each of the eight TV cameras are identical in height and width but with the matrix of elemental detection zones associated with consecutive TV cameras, displaced by one TV scan line.

The foregoing brief description shows simply the basis of the invention, which will now be described in more detail with reference to particularly FIGS. 5 to 9.

The video signal from the surveillance TV camera 20 is fed to the video processor 21 which includes the video amplifier, clamp/sync pulse clipper and video level control from where it is directed on the one hand to a mixer buffer amplifier 23 and on the other hand to a synchronisation pulse separator 24.

In the sync separator 24, line synchronisation and frame synchronisation pulses are removed from the incoming video signal for synchronising the system. A back porch clamp pulse is also generated and is required by the clamp circuitry.

An amplified video signal is taken from the video processor 21 and fed to the mixer buffer amplifier 23 at which point the detection window 16, error strobes 62 and rectangle outline 63 are mixed with a video signal from the surveillance camera 20 for displaying on a conventional TV monitor 25.

The video signal from the video amplifier is clamped to a DC voltage which is adjusted until the synchronisation pulses are clipped from the video signal and, the blanking level established at zero volts.

A proportion of the incoming video signal is derived from a potentiometer and fed to the electronic aperture lens control 26.

The video signal is taken from the clamp/sync clipper circuit via a video level potentiometer and fed to an analogue video switch 27 at this point the video signal is gated by the column gate pulse 75 and is directed to the operational amlplifier integrator 28.

Output from the video switch is integrated over the selected number of scan lines in the operational amplifier integrator 28. The integrator 28 has a determined time constant. An analogue switch is used to reset the integrator to its initial condition.

It is important that the output voltage from the integrator 28 is adjusted to utilise the full dynamic range of the analogue-to-digital converter 29. This is accomplished by a video level monitor 30 which incorporates a peak detector whose output is monitored on a front panel meter. The video level into the integrator 28 is adjusted by a "video level" potentiometer for a full-scale meter reading.

Figure 6:
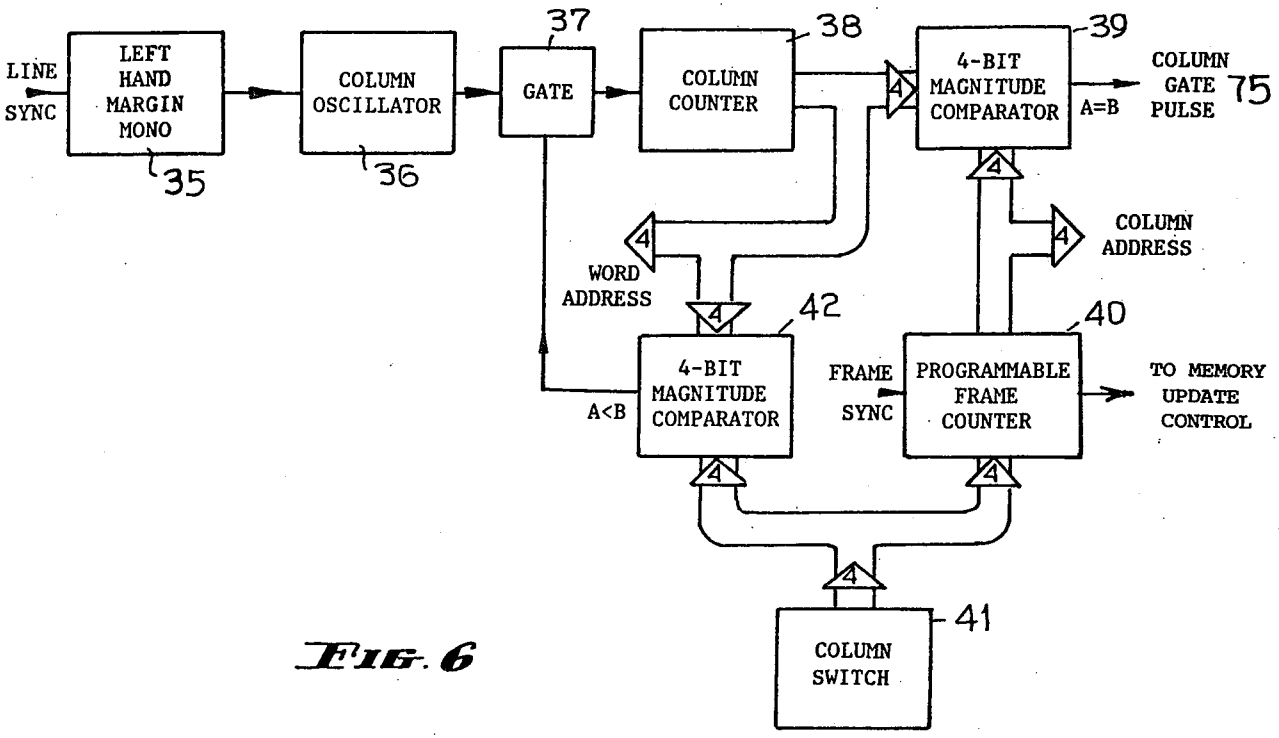
FIG. 6 is a block diagram of a column gate pulse generator.

The column gate pulse generator 31, shown in FIG. 6, is arranged so that line synchronisation pulses trigger a left hand margin monostable multivibrator 35 whose pulse duration inhibits the column oscillator 36 and controls the starting point of the first column. The column oscillator 36 frequency is adjusted to provide a selected period such as 3 microseconds. Output from the oscillator is fed through a gate 37 to a column counter 38 and the column frequency is counted in this 4 stage binary counter 38 and its outputs compared in a 4 bit magnitude comparator 42 with the selected number of columns. When the count exceeds a selected number of columns, a high to low transition on the $A<B$ output inhibits further clock pulses to the counter 38 and the counter 38 is then reset by the next line synchronising pulse. Also, the 4 bit binary output from this counter 38 provides the word address for the detection window memory 50.

TV frames are counted in a programmable frame counter 40 which is initially loaded with the binary setting on the "column" switch 41 and counts down with each frame synchronising pulse until it reaches the count of zero and at which point, the counter 40 is automatically reloaded with the column switch 41 setting to repeat the process. It thus recycles through the states N to 1. The binary output from the counter 40 is compared in a 4 bit magnitude comparator 39 with the binary output from the column counter 38. The column gate pulse 75 equal in width to the column oscillator 36 period is generated from the A equal B output when the two counts coincide.

A further programmable counter 45 controls the number of scan lines defining the height of all elemental detection zones 15. The counter 45 is reset by the frame synchronising pulses and commences counting TV scan lines from the top of the picture. The number of scan lines which defines the height of each elemental detection zone 15 is programmed by a switch assembly. Although the division ratio may be set in the range of 1 to 15, the elemental detection zone memory 49 capacity dictates a minimum height of a selected number of TV scan lines.

Rows of elemental detection zones 15 are counted in an 8 stage binary row counter 46 the counter being reset by the frame synchronisation pulses to commence counting rows from the top of the display. Only the first six binary outputs are used as the row address for the elemental detection zone 49 and detection window 50 memories.

The trailing edge of the last column gate pulse 75 for each elemental detection zone 15 triggers a monostable multivibrator which generates a one microsecond start conversion pulse and this pulse then initiates the analogue-to-digital conversion.

A relatively slow analogue-to-digital converter 29 with a 25 microsecond conversion time is suitable to convert the voltage output from the integrator 28 (corresponding to the integrated video signal over the elemental detection zone 15) to its 8 bit digital equivalent. The analogue-to-digital conversion is initiated by a start conversion pulse and immediately the analogue-to-digital converter 29 negates a BUSY output. The positive transition of the BUSY output indicates that the analogue-to-digital conversion is complete and that the digitized value is stored in an internal latch. This 8 bit output is compared in the arithmetic logic unit 48 with a previous value stored in the elemental detection zone memory 49 for the same elemental detection zone 15 to determine if a change in video signal has resulted.

The positive transition of the BUSY signal from the analogue-to-digital converter 29 triggers a monostable multivibrator whose output pulse width is set to approximately 14 microseconds and this pulse resets the integrator 28 to its initial condition in readiness to integrate the next elemental detection zone 15.

An inverting operational amplifier is used for the integrator 28 and, since the input voltage is always positive with respect to zero volts, the output from the integrator 28 is always negative. For this reason the analogue switch across the integrator capacitor must operate between zero and a negative voltage of say 12 volts. A voltage level translator converts the positive output reset pulse to a negative going pulse.

Initially the 8 bit digital equivalent of every elemental detection zone 15 is stored in a $1024\times8$ bit CMOS random access memory 49. These values are periodically updated to compensate for objects which move permanently into or out of the scene, slow changes in ambient light level and thermal drifts within the TV camera. Elemental detection zones 15 are addressed by the binary output from the programmable frame counter 40 and from the row counter 46.

The memory update control 32 contains a programmable memory update counter whose output is applied to the write pulse logic 33 and which gates write pulses to the elemental detection zone memory 49. The output frequency from the programmable frame counter 40 is initially divided by 10 before being fed to the memory update counter. Memory update rates are thus a function of the selected number of columns. Table 1 shows memory update rates versus memory update switch settings for 2 to 4 columns.

TABLE 1

| MEMORY UPDATE RATES (SECONDS) | | | | | | | |
|---|---|---|---|---|---|---|---|
| MEMORY UPDATE SWITCH | COLUMNS | | | | | | |
| | 2 | 4 | 6 | 8 | 10 | 12 | 14 |
| 1 | 0.4 | 0.8 | 1.4 | 1.6 | 2.0 | 2.4 | 2.8 |
| 2 | 0.8 | 1.6 | 2.8 | 3.2 | 4.0 | 4.8 | 5.6 |
| 3 | 1.2 | 2.4 | 4.2 | 4.8 | 6.0 | 7.2 | 8.4 |
| 4 | 1.6 | 3.2 | 5.6 | 6.4 | 8.0 | 9.6 | 11.2 |
| 5 | 2.0 | 4.0 | 7.0 | 8.0 | 10.0 | 12.0 | 14.0 |
| 6 | 2.4 | 4.8 | 8.4 | 9.6 | 12.0 | 14.4 | 16.8 |
| 7 | 2.8 | 5.6 | 9.8 | 11.2 | 14.0 | 16.8 | 19.6 |
| 8 | 3.2 | 6.4 | 11.2 | 12.8 | 16.0 | 19.2 | 22.4 |
| 9 | 3.6 | 7.2 | 12.6 | 14.4 | 18.0 | 21.6 | 25.2 |

It should be noted that the elemental detection zone memory 49 is not updated until after the previous value has been compared with the present value so that all TV frames are actively used.

The arithmetic logic unit 48 is divided into two subsections, an 8 bit subtractor and an 8 bit adder/subtractor which is controlled by the carry bit from the first subsection. The 8 bit value (B) for each elemental detection zone 15 stored in the elemental detection zone memory 49 at some previous time, is subtracted from its present value (A) from the analogue-to-digital converter 29. If the result A-B is negative, the carry bit from the first subsection configures the second subsection as an adder and the difference is added to a 4 bit binary coded decimal (BCD) sensitivity setting obtained from a front panel thumbwheel switch. A negative result from the second subsection arises if the difference exceeds the sensitivity setting. This causes an error strobe 62 to be generated.

If the result A-B from the first subsection is positive, the second subsection is configured as a subtractor and the difference is substracted from the sensitivity setting. Again, an error strobe 62 is generated if the result is negative.

Figure 7:
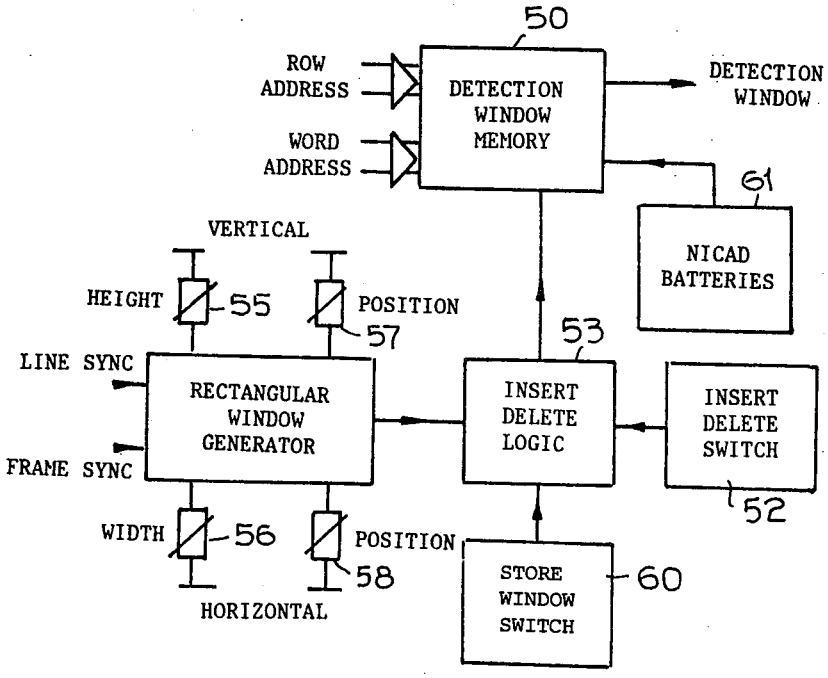
FIG. 7 is a block diagram of the rectangular window generator and how it is applied to the detection window memory.

The movement detector of this invention described particularly with reference to FIG. 7, features a unique concept of a user programmable detection window 16, this being accomplished by a separate 1024×1 bit random access memory 50 (RAM) which has one bit assigned to each elemental detection zone 15. If a memory location is set at a logical zero, the elemental detection zone 15 associated with that address will be deleted from the detection window 16 and, if set to a logical one, the elemental detection zone 15 will be included in the window 16.

The detection window 16 is composed by using the rectangle generator 51 whose height, width and position is adjusted to surround any block of elemental detection zones 15. This block is then added to the detection window 16 by placing the INSERT-/DELETE switch 52 which is coupled to the insert delete logic 53 in the INSERT mode and operating the momentary button STORE WINDOW 60. Alternatively, in the DELETE mode, this block is deleted from the detection window 16.

The position, height and width of the rectangle is controlled by four front panel potentiometers 55, 56, 57 and 58. A thin outline 63 of the rectangle is generated and mixed with the video signal to indicate which group of elemental detection zones 15 has been selected. This outline 63 may be deleted from the video display by a front panel switch.

The memory 50 is automatically cleared of any random bit pattern when the movement detector is switched on but during a power failure the detection window pattern 16 is retained for several hours by floating the RAM 50 across rechargeable nickel cadmium batteries 61 which it is preferred to supply for this purpose.

The present value of each elemental detection zone 15 is compared in the arithmetic logic unit 48 with its previous stored value. If the absolute difference between these two values exceeds the sensitivity setting, a carry bit or error signal is generated which is gated with the detection window 16 and fed to the alarm circuitry 47. Hence, error strobes 62 associated with elemental detection zones 15 occurring only within the detection window 16 trigger the alarm circuits 47. Also errors occurring within the detection zone 16 cause error strobes 62 to be mixed with the video signal, underlining the elemental detection zones 15 where the errors have occurred, see lines 62 FIG. 3.

These strobes 62 trigger two monostable multivibrators, one of which drives an audible alarm which continues until approximately 2 seconds after the last error strobe 62. The other multivibrator driving a relay whose contacts are available at the rear panel, which contacts are intended to operate a video recorder when the movement detector is used in an unattended application. Again, the multivibrator operates in a retriggerable mode where the relay remains operated for approximately 5 seconds after the last error signal 62.

Figure 8:
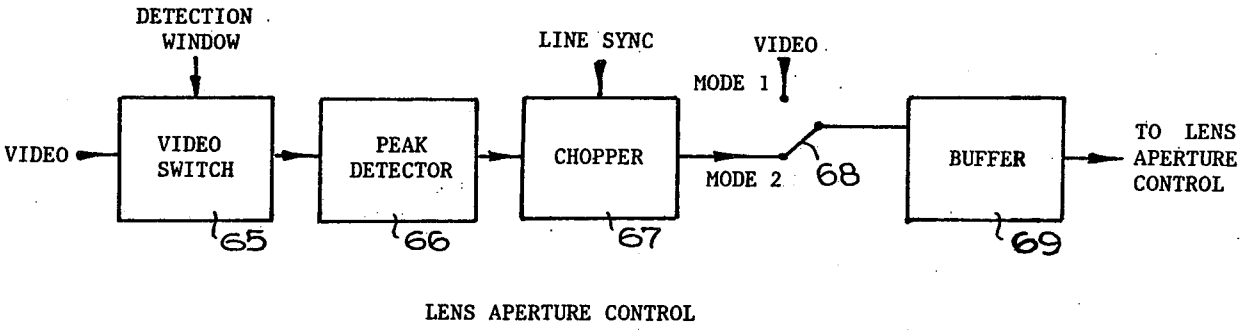
FIG. 8 is a diagram showing the lens aperture control of a camera.

Referring now to FIG. 8 which refers to the lens aperture control 26, a DC restored video signal from the video processor 21 is gated by the detection window 16 in an analogue switch 65 and fed to a peak detector 66, the output of which is chopped in an analogue switch 67 by the line synchronising pulses to create an artificial video signal whose amplitude is proportional to the peak video signal occurring only within the detection window 16. Either this signal or the video signal directly from the surveillance camera is selected by a switch 68 and fed to a buffer amplifier 69 which drives the electronic aperture control on the lens.

From the foregoing it will be appreciated that an improved form of video movement detector which can operate on relatively low power is provided and which is a substantial improvement over earlier devices for this nature.

Figure 9:
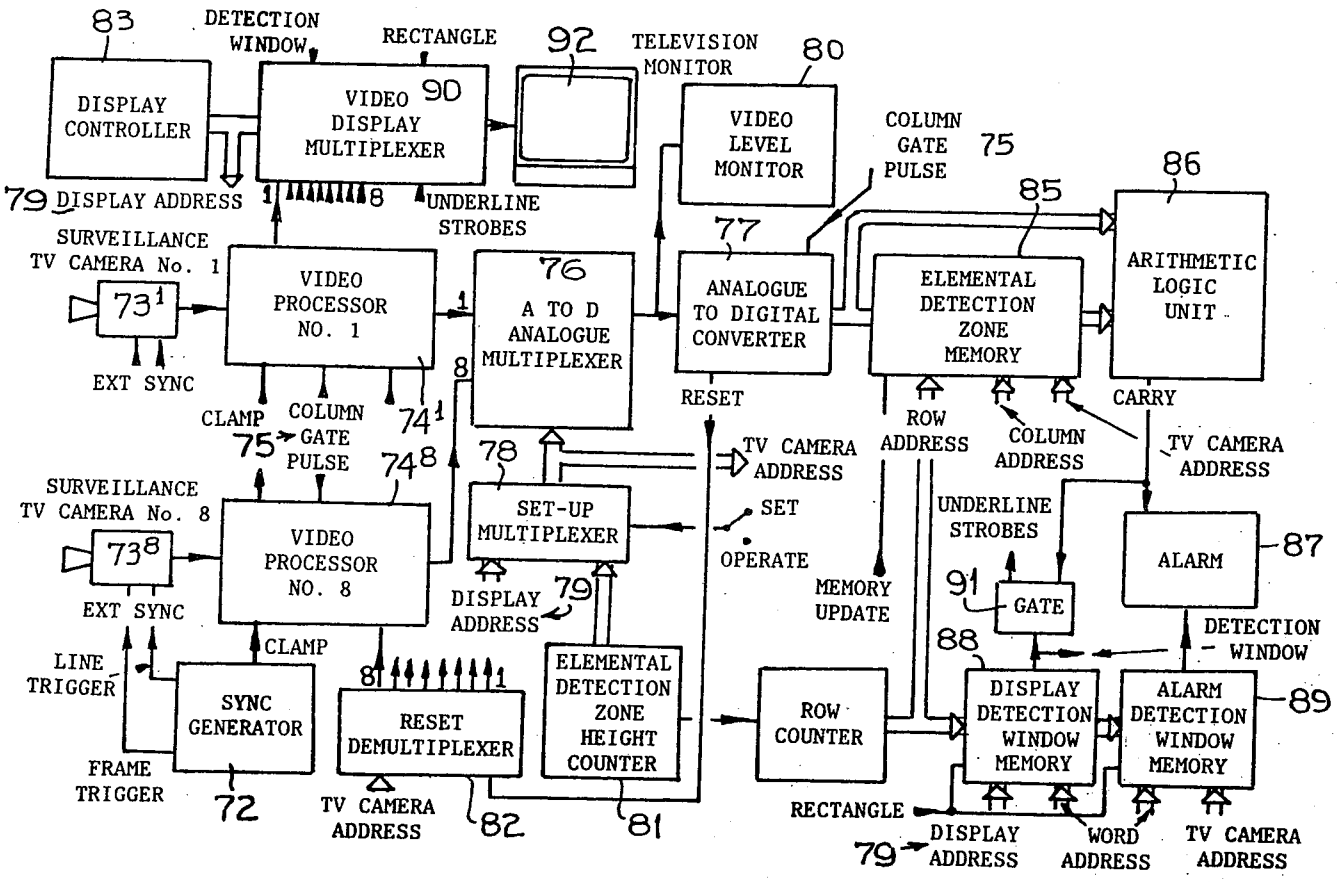
FIG. 9 is a view corresponding to FIG. 5 but showing a multiple camera arrangement.

In the multi-camera form shown particularly by the block diagram of FIG. 9, the sync separator 24 shown in FIG. 5 is replaced by a sync pulse generator 72 which generates line and frame trigger pulses for synchronising the line and frame frequencies of each surveillance TV camera $73^1$ to $73^8$. It also provides line and frame synchronising pulses and a line back porch clamp pulse for internal operation of the video movement detector.

The video amplifier, clamp/sync clipper, video level potentiometer, video switch, operational amplifier integrator and voltage level translator are duplicated in video processors $74^1$ to $74^8$ for each surveillance TV camera connected to the movement detector. Generation of the column gate pulse 75 is identical to the single camera design. This gate pulse is applied in parallel to all video switches.

The analogue output from each operational amplifier integrator is fed to the multiplexer 76 and in turn into an A/D converter 77. Multiplexing is controlled by the binary output from the set-up multiplexer 78. In the SET mode, the display address 79 is selected and applied to the A to D and analogue multiplexer 76. This address may be set to select the output from any one integrator enabling the video level potentiometer to be adjusted by observing a video level meter in the video level monitor 80. In the OPERATE mode, the binary output from the elemental detection zone height counter 81 is applied to the A to D analogue multiplexer 76. When set to 8 TV scan lines in height, this counter 81 is incremented by the column gate pulse 75 and cycles through the states 0 to 7, sequentially directing the integrator outputs to the A/D converter 77.

In this form of the device, a start A/D conversion pulse is generated after every column gate pulse 75. The A/D converter 77 thus operates on every scan line. The reset pulse is generated at the end of each A/D conversion.

The reset pulse is demultiplexed to reset the appropriate operational amplifier integrator by the reset demultiplexer 82. Demultiplexing is controlled by the binary output from the set-up multiplexer 78. In the SET mode, the display address 79 from the display controller 83 is applied to the reset demultiplexer 82. Setting any fixed address causes the system to behave as a single TV camera system with the ability to select any one of the 8 TV cameras. In the OPERATE mode, each integrator is reset in turn after its output is multiplexed to the A/D converter 77 and converted to its binary equivalent.

In the example shown, the elemental detection zone memory capacity must be increased by a factor of 8 over the single camera design to accommodate data generated by digitizing the elemental detection zones 15 for eight TV cameras. In principle, the elemental detection zone memory 85 is partitioned into eight $1024\times8$ bit segments with each segment selected by the binary TV camera address. When in the SET mode, this binary address may be applied statically, effectively causing the system to operate as a single camera design. In the OPERATE mode, the memory segment associated with each of the 8 TV cameras is selected by the TV camera address lines.

The present digitized output for each elemental detection zone 15 is compared as before in the arithmetic logic unit 86 with its previously stored value. A carry bit is generated if the absolute difference between these two values exceeds a sensitivity setting. The sensitivity setting may be multiplexed to allow different sensitivity settings for each TV camera. The carry bit is gated separately by the outputs of the alarm 89 and display detection window 88 memories.

These two memories are identical and the data defining the detection window characteristics stored in each memory are identical. Again, each memory can be considered as partitioned into 8 segments with one segment assigned to each TV camera. The detection window shape is composed in the SET mode. In this mode, the TV camera address and display address 79 are identical and applied statically enabling separate detection windows 16 to be composed for each TV camera.

When in the OPERATE mode, the alarm detection window memory 89 is addressed by the output from the set-up multiplexer 78. The carry or error signals generated by the arithmetic logic unit 86 are gated by the detection window 16 associated with the appropriate TV camera.

The display detection window memory 88 cycles at a rate determined by the display controller 83. This address may be either static or cycle at a preset rate. Its purpose is to output the detection window pattern 16 for superimposing on the selected video display. Strobes 62 for underlining the elemental detection zones 15 in error are generated by gating 91 the output of the display detection window memory 88 with the carry from the arithmetic logic unit 86.

The video signal from any one of the eight surveillance TV cameras may be selected in the video display multiplexer 90 and presented on the TV monitor with the appropriate detection window 16 and underline strobes 62 superimposed. Selection is controlled by the display address from the display controller 83.

The display controller 83 operates in the following modes;

(a) Cyclic mode. The display address steps through the binary sequence 0–7 at a preset rate, sequentially displaying the output from each TV camera with its appropriate detection window 16 superimposed, (b) Set-up mode. A fixed binary number may be applied to the display address to select and display the video from any TV camera, for setting video level and for composing the detection window 16.

(c) Alarm initiated mode. The alarm sets the display address to display the video signal from the TV camera which generated the error.

The claims defining the invention are as follows:

1. The method of detecting motion by means of a video detector which consists in:

(a) directing at least one television camera (20) into the surveillance area, (b) reproducing the image from the said camera on a TV screen (25), (c) dividing the TV screen display into a matrix of elemental detection zones (15) positioned in a selected number of columns with each detection zone (15) being a selected number of scan lines high, (d) processing the elemental detection zones (15) in each column in a sequential manner with at least one selected column processed in each TV frame by submitting a first detection zone (15) in the said column to an integrator (28) and continuing integration of the signal in the said column until, at the end of a selected gate pulse (75), a start conversion pulse is applied to an analogue-to-digital converter (29) to issue a "busy" signal and holding the "busy" condition while conversion to a digital format is in progress, whereby at the last scan line conversion to digital format in the analogue-to-digital converter (29) occurs, (e) placing the digital format into a memory (49), (f) resetting the integrator (28) to process the next elemental detection zone (15) of the said column until the zones (15) in the said column are completed and then sequentially similarly submitting all remaining columns to the said integrator (28) one for each succeeding frame, (g) comparing subsequently produced scans with earlier corresponding scans to detect errors (62) representing movement, and (h) defining by means of at least a window (16) of selectable dimensions those errors (62) to be directed to the alarm circuitry (47).

2. The method of claim 1 wherein a strobe signal (62) is added to any elemental detection zone (15) in the window (16) where a difference occurs between the earlier stored value and a subsequent value and initiating an alarm signal where such error (62) occurs in the said window (16).

3. The method of claim 1 or 2 wherein the said window (16) is programmable to have areas within the said window (16) deleted or areas outside of the said window (16) added to process only those elemental detection zones (15) selected for surveillance said programming being effected by a rectangle generator (51) whose height, width and position is adjustable and which is arranged after selection of a rectangle (63) to hold or delete the defined space to build a window (16) including only selected elemental detection zones (15).

4. The method of claim 1 or 2 wherein the lens aperture of the said video camera (20) is controlled by gating the video signal by the detection window (16) only and feeding the signal to a peak detector (66), and chopping (67) the signal by the line synchronisation pulses to provide a video signal to the lens whereby to control the said aperture independently of light values outside of the said window (16).

5. The method of claim 1 or 2 wherein the lines are interlaced, the processing of even scan lines in each elemental detection zone (15) in alternate columns, and processing of odd scan lines in each elemental detection zone (15) in the columns intermediate thereto.

6. The method of claim 1 or 2 wherein a plurality of TV cameras (73) are used, not exceeding the number of scan lines which define the height of each elemental detection zone (15), and the video signal from each TV camera (73) is coupled to its associated integrator (74) which is actuated to feed its output through a multiplexer (76) to the said analogue-to-digital converter (77) during the idle time between the start signal and the last line scan of a preceding integration of an elemental detection zone (15) and multiplexing (76) the signals from the multiple camera array (73) for memory storage (85) and subsequent processing for error detection.

7. The method of claim 1 or 2 wherein the said window (16) is programmable to have areas within the said window (16) deleted or areas outside of a said window (16) added to process only those elemental detection zones (15) selected for surveillance said programming being effected by a rectangle generator (51) whose height, width and position is adjustable and which is arranged after selection of a rectangle (63) to hold or delete the defined space to build a window (16) including only selected elemental detection zones (15), and wherein a strobe signal (62) is added to any elemental detection zone (15) in the window (16) where a predetermined difference occurs between the earlier stored value and a subsequent value and initiating an alarm signal where such error occurs in the said window (16), and wherein the lens aperture is controlled by the illumination existing only in the said window (16).

8. A video movement detector wherein at least one TV camera (20) is directed into the surveillance area to reproduce the image from the said camera (20) on a TV screen (25) characterized by means to divide the TV screen display into a matrix of elemental detection zones (15) positioned in a selected number of columns with each detection zone (15) being a selected number of scan lines high, an integrator (28) to process the elemental detection zones (15) in each column in a sequential manner within at least one selected column in each TV frame, an analogue-to-digital converter (29) to receive the integrated video signal at the last scan line of each elemental detection zone (15), a gate (27) to transfer the video signal from the said surveillance camera (20) to the said integrator (28) arranged to continue integration of the signal in the said column until, at the end of every selected gate pulse (75), a start conversion pulse is applied to the said analogue-to-digital converter (29) to issue a "busy" signal, means to hold the "busy" condition while conversion to the digital format is in progress, a memory (49) to receive and store the said data, means to reset the integrator (28) to process the next elemental detection zone (15) of the said column, gate means to sequentially similarly submit all remaining columns to the said integrator (28) at least one for each succeeding frame, and a comparator (48) for comparing subsequently produced scans with earlier corresponding scans to detect errors (62) representing movement, and means to define at least one window (16) of selectable dimensions on said TV screen display (25), and means to direct error signal (62) generated in said window (16) to indicator means (62, 47).

9. The video movement detector of claim 8 characterized by a strobe signal generator connected to add a strobe signal (62) to any elemental detection zone (15) in the window (16) where a predetermined difference occurs between the earlier stored value and a subsequent value and optionally an alarm signal generator (47) actuated where such error (62) occurs in the said window (16).

10. The video movement detector of claim 8 or 9 characterized by means to program the said window (16), and means to delete or add areas within the said window (16) or areas outside of a said window (16) to process only those elemental detection zones (15) selected for surveillance, said programming being effected by a rectangle generator (51) by adjusting height, width and position of a rectangle (63), and means to hold or delete the defined rectangular space to build a window (16) including only selected elemental detection zones (15).

11. The video movement detector of claim 8 or 9 characterized by means to control the lens aperture (26) of the said video camera (20) by gating the signal from the detection window (16) only, means to feed the signal to a peak detector (66), and means to chop (67) the signal by the line synchronisation pulses to provide a video signal to the lens and means to actuate the diaphragm of the said lens from the said video signal to control the said aperture independently of light values outside of the said window (16).

12. The video movement detector of claim 8 or 9 wherein the scan lines are interlaced, characterized by means to process even scan lines in each elemental detection zone (15) in alternate columns, and processing of odd scan lines in each elemental detection zone (15) in the columns intermediate thereto.

13. The video movement detector of claim 8 or 9 wherein a plurality of TV cameras (73) is used, not exceeding the number of scan lines which define the height of each elemental detection zone (15), characterized by means associated with each camera to feed its signal through a multiplexer (76) to the said analogue-to-digital converter (77) during the idle time between the start signal and the last line scan of a preceding integration of an elemental detection zone (15), and a multiplexer (78) to sequentially direct the signals from the said analogue-to-digital converter (77) to a memory storage (85) and subsequent processing for error detection.

14. The video movement detector of claim 8 or 9 characterized by means to program the said window (16), and means to delete or add areas within the said window (16) or areas outside of a said window (16) to process only those elemental detection zones (15) selected for surveillance, said programming being effected by a rectangle generator (51) by adjusting height, width and position of a rectangle (63), and means to hold or delete the defined rectangular space to build a window (16) including only selected elemental detection zones (15), and further characterized in that the lens aperture of the said video camera is variable and by gate means taking the signal from the detection window (16) only to avoid problem areas, means being provided to feed the signal to a peak detector (66) to provide a video signal to the lens coupling means being positioned to actuate the diaphragm of the said lens from the said video signal to control the said aperture independently of light values outside of the said window (16).

15. A video movement detector wherein a plurality of TV cameras (73) for each detection zone are directed into surveillance areas to reproduce the image from the said cameras (73) on a TV screen (92), characterized by means to divide the TV screen display into a matrix of elemental detection zones (15) positioned in a selected number of columns with each detection zone (15) being a selected number of scan lines high, means to define at least one window (16) of selectable dimension to select the elemental detection zones (15) to be processed, an integrator for each TV camera (73) to process the elemental detection zones (15) within each column in a sequential manner with at least one selected column processed in each TV frame, a multiplexer (76) receiving the signal from each integrator and sequentially feeding the signal to an analogue-to-digital converter (77) connected to the said multiplexer (76) to process the data at the last scan line of each elemental detection zone (15), means to apply to the analogue-to-digital converter a start conversion pulse at the end of every selected gate pulse to issue a "busy" signal, means to hold the "busy" condition while conversion to the digital format is in progress, a multiplexer (78) to direct the processed data to a memory (85) to store the said data, means to reset the integrator to process the next elemental detection zone (15) of the said column, gate means to sequentially similarly submit all remaining columns to the said integrators one for each succeeding frame, and a comparator (86) for comparing subsequently produced scans with earlier corresponding scans to detect errors representing movement, and means to indicate when and where such errors occur.

* * * * *